US005095860A

United States Patent [19]

Newell

[11] Patent Number: 5,095,860

[45] Date of Patent: Mar. 17, 1992

[54] ENGINE VALVE COVER APPARATUS

[76] Inventor: Bobby T. Newell, Rt. 1, Box 70-B, Ayden, N.C. 28513

[21] Appl. No.: 719,621

[22] Filed: Jun. 24, 1991

[51] Int. Cl.[5] ..... F01M 9/10

[52] U.S. Cl. ..... 123/90.38; 123/195 C

[58] Field of Search ..... 123/90.37, 90.38, 195 C, 123/198 E

[56] References Cited

U.S. PATENT DOCUMENTS

| | | | |
|---|---|---|---|
| 2,877,756 | 3/1959 | McCauley et al. | 123/90.38 |
| 3,568,799 | 3/1971 | Bivins | 123/90.37 |
| 4,498,433 | 2/1985 | Ogawa | 123/195 C |
| 4,522,165 | 6/1985 | Ogawa | 123/195 C |
| 4,538,560 | 9/1985 | Alden | 123/195 C |
| 4,593,659 | 6/1986 | Wells et al. | 123/90.38 |
| 4,608,950 | 9/1986 | Payne et al. | 123/195 C |

*Primary Examiner*—E. Rollins Cross
*Assistant Examiner*—Weilun Lo
*Attorney, Agent, or Firm*—Leon Gilden

[57] ABSTRACT

A trough shaped engine cover is arranged for mounting to a top portion of an overhead valve internal combustion engine. The valve cover includes a series of spaced boss members directed through a top wall of the valve cover, with each boss member defining a conduit mounting a removable plug assembly removably mounted relative to the conduit. Each conduit is coaxially aligned with a fulcrum portion of a rocker arm of the overhead valve assembly to permit access to the fulcrum by an adjusting wrench.

5 Claims, 4 Drawing Sheets

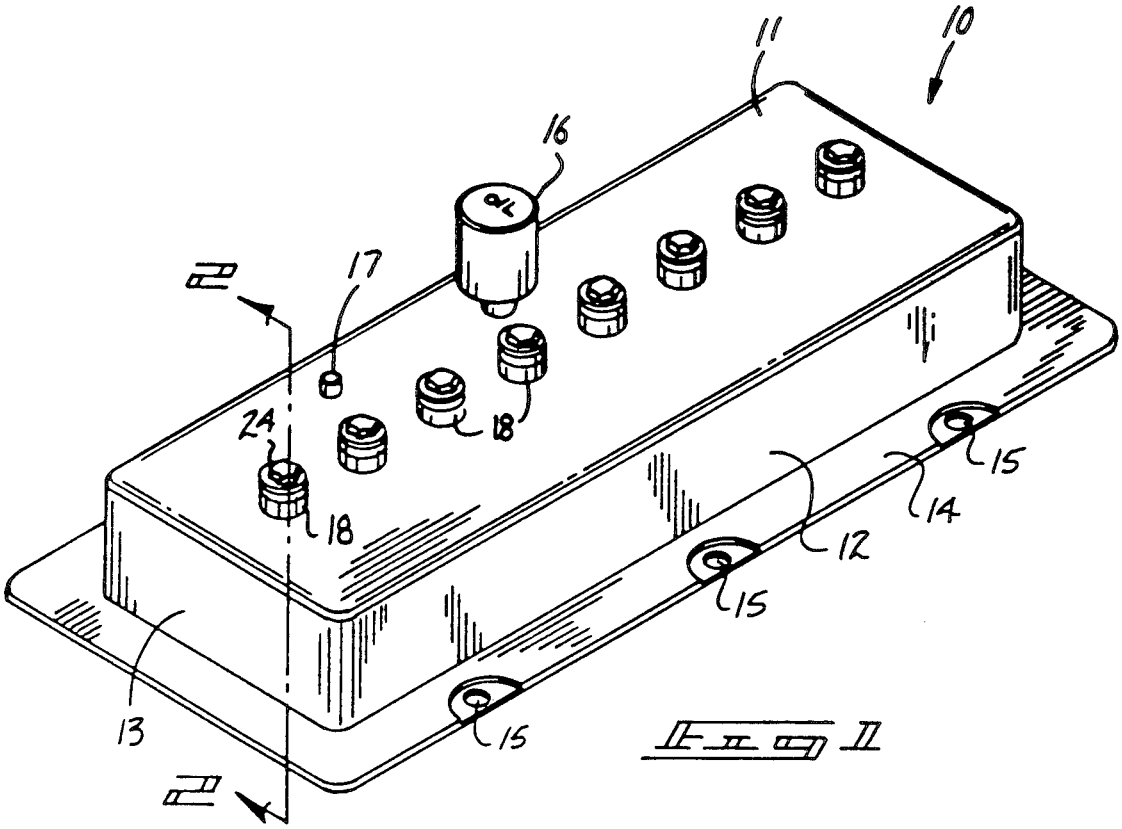
Fig 1
Fig 2
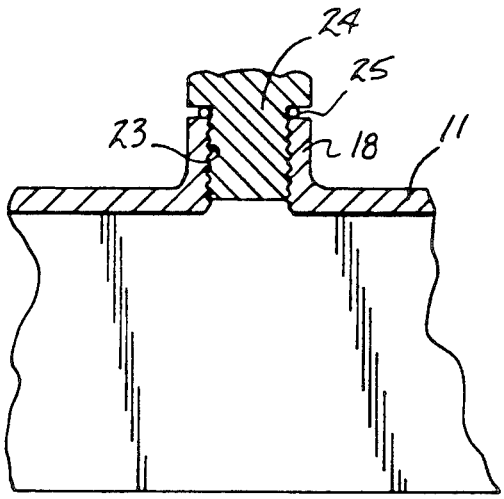

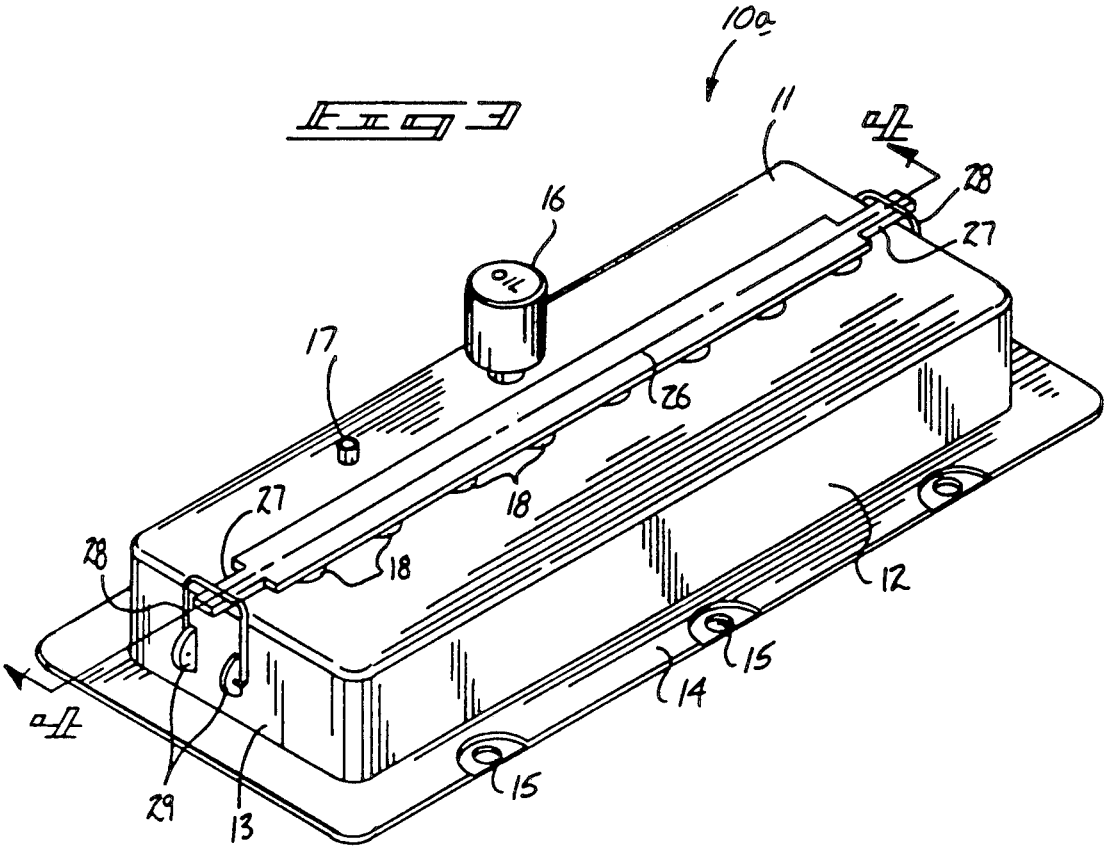
FIG 3
FIG 4
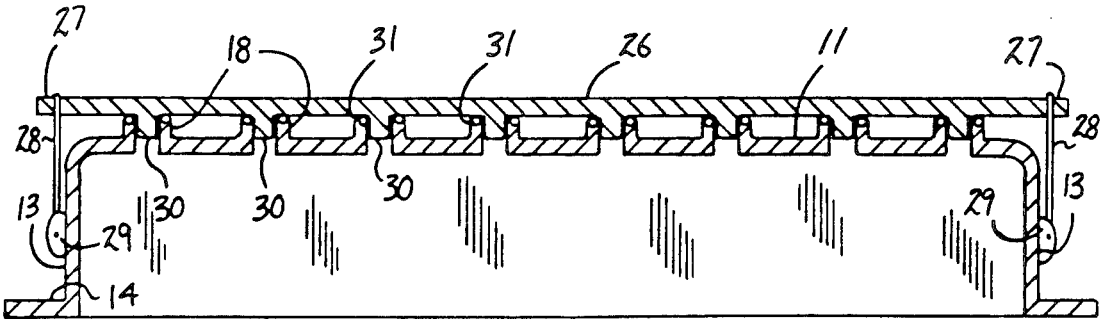

21
18
12
11
22
14
19
20

ENGINE VALVE COVER APPARATUS

BACKGROUND OF THE INVENTION

1. Field of the Invention

The field of invention relates to valve cover apparatus, and more particularly pertains to a new and improved engine valve cover apparatus wherein the same is arranged to permit access for adjustment of the valves of an internal combustion engine.

2. Description of the Prior Art

Adjustment of overhead valve rocker arms provide proper valve adjustment or valve lash in an internal combustion engine has heretofore been a relatively combersome job associated with oil spillage about the head portion due to the requisite step of removal of an associated valve cover to gain access to the fulcrum adjusting nut of the associated valve rocker arms. Prior art apparatus has heretofore not adequately addressed the problem as illustrated in U.S. Pat. No. 4,164,927 to Congram, et al. setting forth a reinforced stamped rocker arm utilizing bosses directed from the head through the rocker arm to secure the rocker arm to the head.

U.S. Pat. No. 4,788,950 to Finley sets forth valve cover wherein a top portion of the valve cover is pivotally mounted relative to a lowermost portion thereof.

U.S. Pat. No. 4,593,659 to Weels, et al. sets forth an engine valve cover utilizing through-extending openings to receive the studs of underlying rocker arms therethrough.

U.S. Pat. No. 4,538,560 to Alden sets forth a valve cover for an internal combustion engine wherein a lid of the valve cover is removably mouted relative to the side walls thereof.

As such, it may be appreciated that there continues to be a need for a new and improved engine valve cover apparatus as set forth by the instant invention which addresses both the problems of ease of use as well as effectiveness in construction permitting an individual to gain access to each rocker arm for adjustment thereof and in this respect, the present invention substantially fulfills this need.

SUMMARY OF THE INVENTION

In view of the foregoing disadvantages inherent in the known types of valve cover apparatus now preset in the prior art, the present invention provides an engine valve cover apparatus wherein the same utilizes through-extending conduits mounted relative to and coaxially aligned with each rocker arm boss to permit access to each boss for adjustment of each associated rocker arm. As such, the general purpose of the present invention, which will be described subsequently in greater detail, is to provide a new and improved engine valve cover apparatus which has all the advantages of the prior art valve cover apparatus and none of the disadvantages.

To attain this, the present invention provides a trough shaped engine cover arranged for mounting to a top portion of an overhead valve internal combustion engine. The valve cover includes a series of spaced boss members directed through a top wall of the valve cover, with each boss member defining a conduit mounting a removable plug assembly removably mounted relative to the conduit. Each conduit is coaxially aligned with a fulcrum portion of a rocker arm of the overhead valve assembly to permit access to the fulcrum by an adjusting wrench.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine valve cover apparatus which has all the advantages of the prior art valve cover apparatus and none of the disadvantages.

It is another object of the present invention to provide a new and improved engine valve cover apparatus which may be easily and efficiently manufactured and marketed.

It is a further object of the present invention to provide a new and improved engine valve cover apparatus which is of a durable and reliable construction.

An even further object of the present invention is to provide a new and improved engine valve cover apparatus which is susceptible of a low cost of manufacture with regard to both materials and labor, and which accordingly is the susceptible of low prices of sale to the consuming public, thereby making such engine valve cover apparatus economically available to the buying public.

Still yet another object of the present invention is to provide a new and improved engine valve cover apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an othographic view, taken along the lines 2—2 of FIG. 1 in the direction indicated by the arrows.

FIG. 3 is an isometric illustration of a modified aspect of the instant invention.

FIG. 4 is an orthographic view, taken along the lines 4—4 of FIG. 3 in the direction indicated by the arrow.

DESCRIPTION OF THE PREFERRED EMBODIMENT

Figure 5:
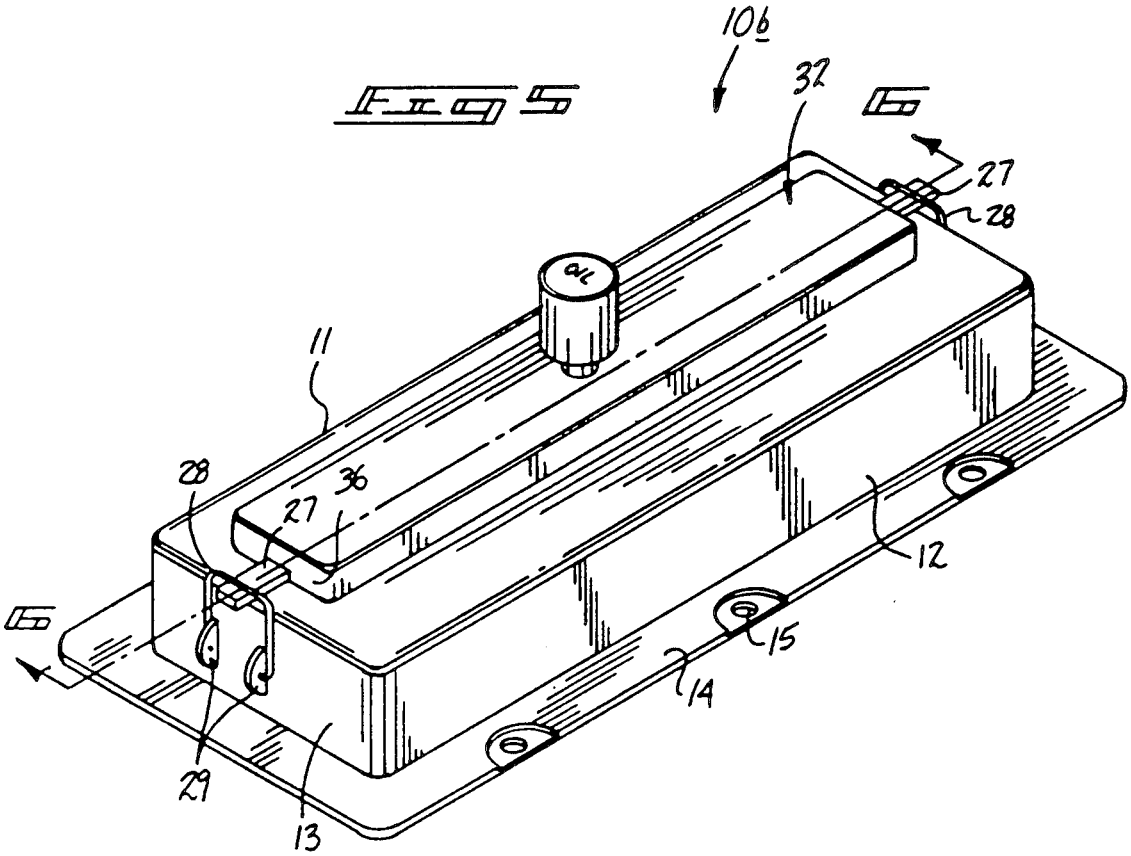
FIG. 5 is an isometric illustration of a further modified aspect of the instant invention.

With reference now to the drawings, and in particular to FIG. 1 to 7 thereof, a new and improved engine valve cover apparatus embodying the principles and concepts of the present invention and generally designated by the reference numerals 10, 10*a*, and 10*b*will be described.

More specifically, the engine valve cover apparatus 10 of the instant invention essentially comprises a housing defined by a trough to include a top wall 11, spaced parallel side walls 12, and spaced parallel end walls 13. A mounting flange 14 is mounted coextensively to a peripheral bottom edge of the side and end walls, as illustrated in FIG. 1. A plurality of flange openings 15 directed through the mounting flange 14 permits securement of the mounting flange to an underlying internal combustion engine head member 20, of a type a illustrated in FIG. 7.

An oil filled plug member 16 is mounted within the top wall 11 permitting access into the housing to direct oil therein, as well as a further access opening 17 accommodating such utility structure as a pollution control valve and the like.

Figure 7:
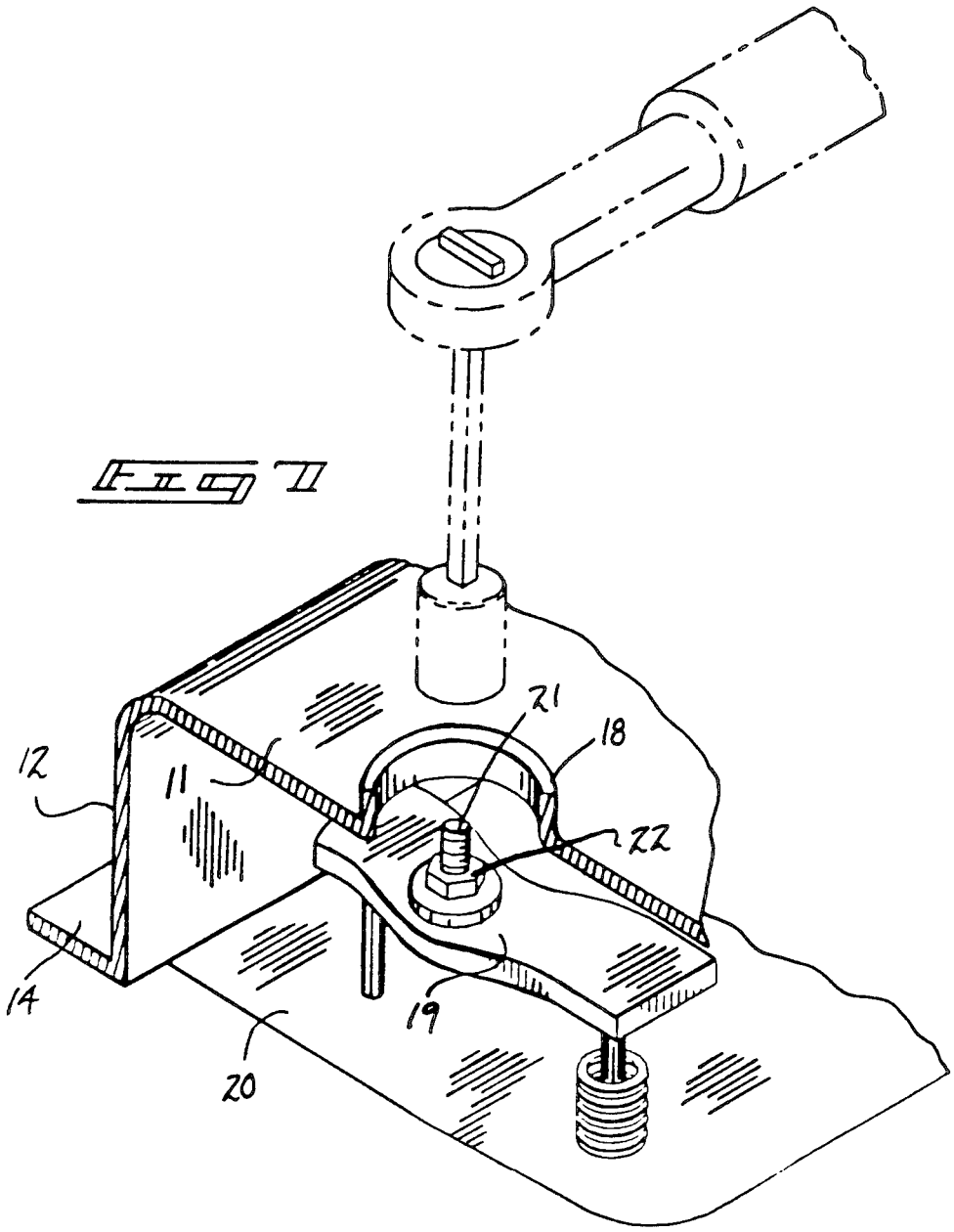
FIG. 7 is an isometric, partially fragmented view illustrating alignment of each through-extending conduit in a top wall of the valve cover relative to a fulcrum boss of an associated rocker arm.

A plurality of cylindrical tube members 18 spaced apart a predetermined spacing orthogonally mounted to the top wall 11, wherein each of the tube members 18 defined a through-extending conduit that is coaxially aligned with a fulcrum boss 21 of an associated rocker arm 19 of the internal combustion engine head member. Each fulcrum boss includes an adjustment nut 22. Each tube member 18 accordingly includes an externally threaded boss plug 24 cooperative with internal threads 23 formed within the tube member 18, whereupon removal of each boss plug 24 permits acces by a socket wrench and the like through each tube member 18 permitting adjustment of the adjustment nut 22 of each rocker arm 19. The cylindrical tube members 18 are spaced apart the predetermined spacing equal to the predetermined spacing between the fulcrum bosses 21 of each rocker arm. Accordingly, a tube member 18 is aligned with an associated rocker arm fulcrum boss 21, as illustrated in FIG. 7 for example. Further, a sealing "O" ring 25 is optionally provided and mounted about each boss plug 24 to effect a sealing between the boss plug 24 and an upper end portion of each tube member 18.

FIG. 3 illustrates a modified cover apparatus 10*a* utilizing a sealing plate 26. The sealing plate 26 is longitudinally and medially aligned relative to the top wall 11 of the housing and is orthogonally oriented relative to each end wall 13. A plate extension leg 27 is longitudinally aligned with the sealing plate 26 and extends beyond each end of the sealing plate 26 and beyond each associated end wall 13. A locking loop 28 pivotally mounted to each end wall 13 is positionable over each extension leg 27. Each locking loop 28 is pivotally mounted to a plurality of spaced parallel flanges 29 as the locking loop 28 is of a "U" shaped configuration, with each leg of the locking loop pivotally mounted within a respective flange 29 of the plurality of flanges. Sealing plug "O"rings 31 are provided in surrounding relationship relative to each sealing plug 30 that is spaced apart the predetermined spacing equal to the predetermined spacing between the tube members 18, as illustrated in FIG. 4.

Figure 6:
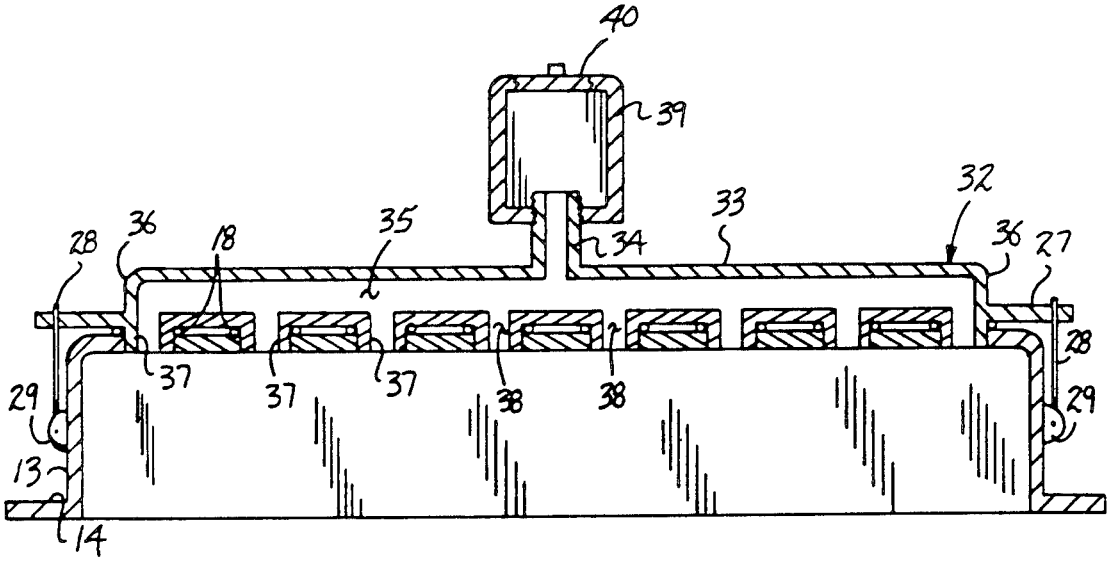
FIG. 6 is an orthographic view, taken along the lines 6—6 of FIG. 5 in the direction indicated by the arrows.

FIGS. 5 and 6 illustrate a further modified apparatus 10*b* including a modified sealing plate housing 32 that includes a plate housing top wall 33, with the plate extension legs 27 extending longitudinally onto each plate housing end wall 36 and orthogonally aligned relative to each end wall 13 of the valve cover housing. The extension legs 27 are secured by the locking loops 28, as discussed above.

The plate housing top wall 33 includes a top wall conduit tube 34 fixedly mounted to the top wall defining a conduit therethrough in communication with a plate housing central housing 35 extending longitudinally of the sealing plate housing 32 between the plate housing end walls 36. A plug tube 37 formed within the plate housing 32 extends downwardly therefrom, wherein each plug tube 37 is spaced apart the predetermined spacing and is received within an associated tube member 18. Each plug tube 37 defines a feed conduit 38 in fluid communication with the plate housing central conduit 35 which in turn is in communication with the top wall conduit tube 34. A fill housing 39 is threadedly secured to an upper terminal end of the top wall conduit tube 34. The fill housing 39 includes a fill housing cap 40 removably mounted relative to a top wall of the fill housing 39, wherein the fill housing includes a bottom wall that is threadedly mounted relative to the top wall conduit tube 34. In this manner, oil additive or oil filling is directed through the fill housing 39 and directed through each feed conduit 38 to direct oil and additive over each fulcrum boss 21 to provide lubrication to each rocker arm 19, as well as directing oil into the rocker arms. In this manner, not only is oil directed into the rocker arm, but an additive may be mounted within the fill housing 39 to direct an oil additive to the fulcrum bosses of each rocker arm during operation of the internal combustion engine.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. An engine valve cover apparatus, comprising, a housing defining a trough-like configuration includes a top wall, spaced side walls, and space end walls, and a continuous mounting flange integrally mounted to a lower terminal edge of the side walls and the end walls spaced from the top wall for securement to a cylinder head of an internal combustion engine, and the top wall includes a predetermined number of cylindrical tube members each spaced apart an equal predetermined spacing integrally and orthogonally mounted to the top wall defining a cylindrical opening, and plug means removably mounted to the top wall, wherein the plug means effects selective plugging of each cylindrical opening of each cylindrical tube member, wherein the plug means defines a sealing plate housing, the sealing plate housing longitudinally aligned medially of the top wall, and the sealing plate housing including plate housing end walls positioned adjacent a top wall when the sealing plate housing is mounted to the top wall, wherein each plate housing end wall includes an extension leg fixedly mounted to each plate housing end wall, and each extension leg extends beyond and orthogonally oriented relative to a respective end wall of said housing end walls.

2. An apparatus as set forth in claim 1, wherein each housing end wall includes a plurality of spaced parallel flanges, and the spaced parallel flanges pivotally mount a "U" shaped locking loop, each "U" shaped locking loop pivotally mounted to the parallel spaced flanges and securable to a respective extension leg of the extension legs of said plate housing end walls.

3. An apparatus as set forth in claim 2 wherein the sealing plate housing includes a plate housing top wall, the plate housing top wall includes a top wall conduit tube, and the sealing plate housing includes a plate housing central conduit extending longitudinally of the sealing plate housing interiorly thereof between the plate housing end walls, with the plate housing central conduit in fluid communication with the top wall conduit tube, and the plate housing central conduit including a plurality of feed conduits, and each feed conduit is sealingly received within one of said cylindrical tube members.

4. An apparatus as set forth in claim 3 wherein the feed conduits are spaced apart said predetermined spacing.

5. An apparatus as set forth in claim 4 wherein the top wall conduit tube includes a fill housing mounted to an upper terminal end of the conduit tube spaced from the top wall, and the fill housing includes a fill housing top wall, and the fill housing includes a fill housing bottom wall, with the fill housing bottom wall mounted to the top wall conduit tube and the fill housing top wall including a fill housing cap selectively removable relative to the fill housing top wall.

* * * * *